United States Patent [19]

Eisele et al.

[11] Patent Number: 4,510,908

[45] Date of Patent: Apr. 16, 1985

[54] FUEL INJECTION PUMP

[75] Inventors: Hermann Eisele, Vaihingen-Enz; Volkhard Stein, Stuttgart, both of Fed. Rep. of Germany

[73] Assignee: Robert Bosch GmbH, Stuttgart, Fed. Rep. of Germany

[21] Appl. No.: 417,975

[22] Filed: Sep. 14, 1982

[30] Foreign Application Priority Data

Mar. 31, 1982 [DE] Fed. Rep. of Germany ..... 3211877

[51] Int. Cl.[3] ..... F02M 59/20

[52] U.S. Cl. ..... 123/449; 123/458; 123/459; 123/506

[58] Field of Search ..... 123/449, 458, 459, 387, 123/503, 506, 511; 417/289, 282

[56] References Cited

U.S. PATENT DOCUMENTS

| | | | |
|---|---|---|---|
| 3,339,534 | 9/1967 | Eheim et al. | 123/387 |
| 3,404,668 | 10/1968 | Eheim et al. | 123/449 |
| 3,538,897 | 11/1970 | Konrath | 123/449 |
| 4,395,987 | 8/1983 | Kobayashi et al. | 123/503 |
| 4,409,939 | 10/1983 | Eheim et al | 123/449 |

FOREIGN PATENT DOCUMENTS 1592921 7/1981 United Kingdom .

*Primary Examiner*—Magdalen Y. C. Moy
*Attorney, Agent, or Firm*—Edwin E. Greigg

[57] ABSTRACT

A fuel injection pump is proposed, based on a fuel injection pump of a known type, which has an adjusting member for determining the injection duration and is provided with a throttle device for determining the effective supply stroke of the pump piston. In accordance with the invention it is proposed that the position of the throttle device be varied by means of a pressure control device, which is controllable by signals of an rpm-dependent electronic control unit. The position of the adjusting member determining the duration of injection remains as constant as possible, while the throttle device adjusts the flowthrough cross section of a connecting line leading from the pump work chamber to a fuel withdrawal chamber in accordance with rpm. Thus it is possible, in particular given the small injection quantities required during idling, to effect a uniformly small injection quantity per unit of time during a relatively long injection duration; this results in a substantial reduction in noise.

11 Claims, 1 Drawing Figure

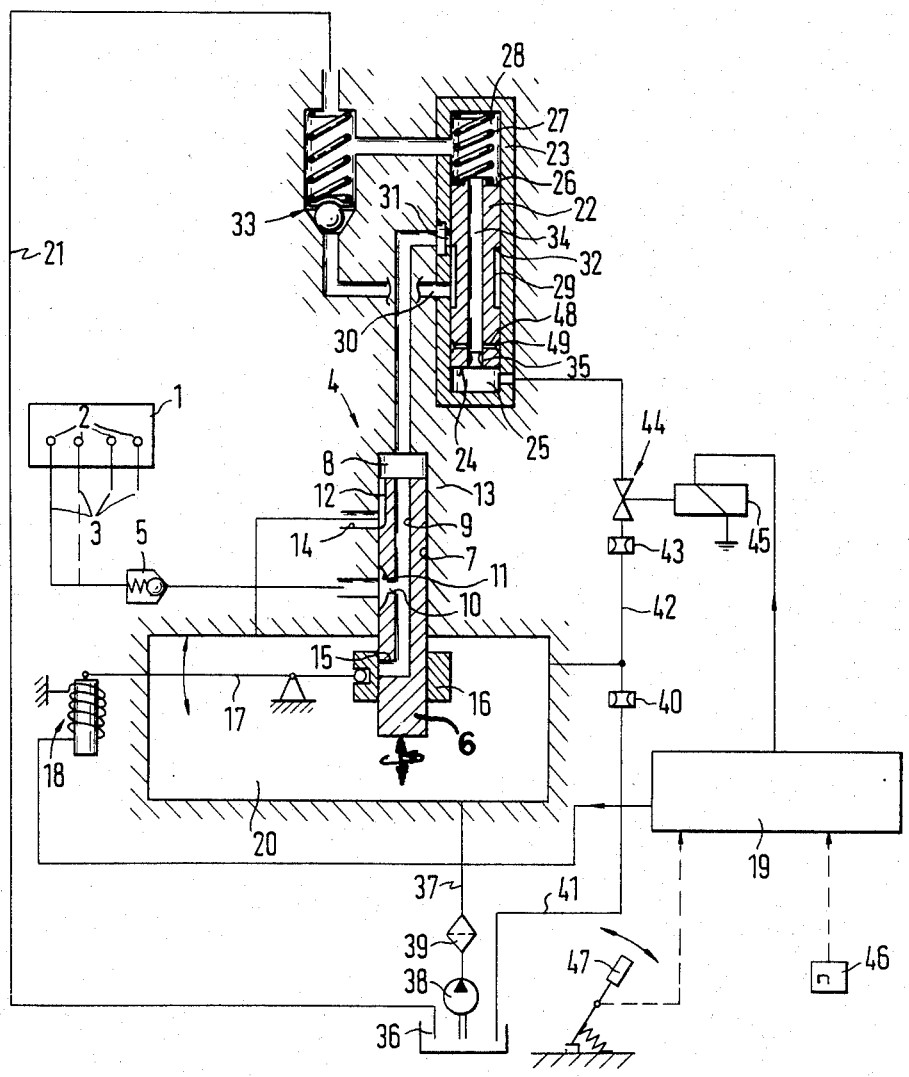
28
27
23
26
22
34
32
29
48
49
35
25
24
33
31
30
21
1
2
3
5
4
8
12
13
9
14
7
11
10
15
16
6
17
18
20
44
45
43
42
40
19
37
41
39
38
36
47
46

FUEL INJECTION PUMP

BACKGROUND OF THE INVENTION

The invention is based on a fuel injection pump having a pump piston, an adjusting member the position of which determines the duration of the fuel variation effected by the pump piston, and a connecting line leading from the pump work chamber to a fuel withdrawal chamber, the cross section of the connecting line being adjustable by means of a throttle device in order to determine the injection quantity. In a known pump of this kind, the duration of fuel supply is determined by the adjusting member embodied as a governor slide, while the injection quantity is varied by an adjustable bypass throttle parallel to the injection nozzle. The supply duration is thus freely selectable, independently of the injection quantity. The variation of the injection quantity, at a predetermined supply duration, is brought about by the variable cross section of the bypass throttle, which is adjusted in turn, via a hydraulic servomotor and a differential-pressure regulating valve, until such time as the injection quantity per unit of time corresponds to the prespecified value of the differential-pressure valve. The supply duration is arbitrarily varied in accordance with the position of the gas pedal by varying the position of the slide. However, the entire quantity of fuel pumped over the duration of supply does not reach the injection valve. Some of it flows out via the adjustable bypass throttle. In this known fuel injection pump, however, there is no particular provision made for regulating the injection quantity during idling operation.

OBJECT AND SUMMARY OF THE INVENTION

The fuel injection pump according to the invention as further described hereinafter and finally claimed has the advantage over the prior art that, using simple means, it is possible to effect an rpm-dependent regulation of the injection quantity for idling given a long, freely selectable injection duration, in order to attain smooth and knock-free combustion during idling. Since during idling the rpm can be used as a standard for the injection quantity, then regulation of the injection quantity can be effected by detecting only the rpm and the position of the driving pedal; these two values together produce a signal of an electronic control unit for a pressure control device. The pressure control device, in turn, adjusts the throttle device in order to determine the injection quantity. The dependent claims disclose further developments of the fuel injection pump disclosed in the main claim.

The invention will be better understood and further objects and advantages thereof will become more apparent from the ensuing detailed description of a preferred embodiment take in conjunction with the drawing.

BRIEF DESCRIPTION OF THE DRAWING

The single FIGURE of the drawing illustrates an embodiment of the invention which is described in greater detail below.

DESCRIPTION OF THE PREFERRED EMBODIMENT

In the drawing, an internal combustion engine engine 1 is illustrated in simplified form. It is supplied with fuel in the conventional manner via injection valves 2 and injection lines 3 leading to these valves from an injection pump 4. In each of the injection lines 3, there is a relief valve 5 opening in the direction toward the injection valve 2. The injection pump 4, in the illustrated example, is a distributor injection pump having a pump piston 6, which in a manner known per se is caused by means not shown to reciprocate and simultaneously rotate counter to the force of a restoring spring. The pump piston 6 moves within a closed cylinder 7 and with one end face it defines a pump work chamber 8. During the supply stroke of the pump piston 6, the pump work chamber 8 communicates via a longitudinal conduit 9 in the pump piston 6 and via a radial bore 10 branching off from the longitudinal groove 9 and having an adjacent longitudinal distributor groove 11, with one of the injection lines 3 leading away from the cylinder 7. The injection lines 3 are distributed at a uniform distance from one another about the cylinder 7, corresponding in number to the number of engine cylinders to be supplied with fuel, and as a result of the rotational movement of the pump piston 6 they are connected one after another with the longitudinal distributor groove 11 in the coarse of the supply stroke.

During the intake stroke, the pump work chamber 8 of the pump 4 is supplied with fuel via longitudinal grooves disposed in the jacket face of the pump piston 6 and via a bore 14 formed in the pump housing.

The longitudinal conduit 9 of the pump piston 6 is embodied as a blind bore. It communicates with a relief conduit 15 in the form of a radial bore of the pump piston 6. The opening of the relief conduit is controlled by means of the upper edge of an annular slide 16 displaceably disposed on the pump piston 6. The position of the annular slide 16 is determined via a lever 17, which is capable of assuming a substantially constant position but can also be adjusted in accordance with selected operating parameters. For this purpose, there is a servomotor 18, which in the exemplary embodiment can be influenced by the signals of an electronic control unit 19. Depending upon the position of the annular slide 16, the relief conduit 15 may remain closed during the entire supply stroke of the pump piston 6. If on the other hand the annular slide 16 is set at a lower position, then the relief conduit 15 is opened up toward the end of the supply stroke, and the supply pressure in the pump work chamber 8 is reduced abruptly, because from this instant on the entire quantity of fuel then being pumped can flow out into a relief chamber 20, which in this case is the suction chamber of the pump.

From the relief chamber 20, the pump work chamber 8 is supplied with fuel via the bore 14. A connecting line 21 which cannot be closed by the pump piston 6 also begins at the pump work chamber 8 and discharges into a fuel supply container 36. A throttle device embodied as a piston slide 22 is provided in the connecting line 21 following its outlet from the pump work chamber 8. The piston slide 22 is disposed in a cylinder 23, and with one end face 24 it defines a control chamber 25. The other end face 26 is engaged by a compression spring 27, which is supported in a relief chamber 28 of the cylinder 23. The piston slide 22 has an annular groove 29, which overlaps the outlet opening 30 of the connecting line 21 from the cylinder 23, while the inlet opening 31 of the connecting line 21 into the cylinder 23 can be sealed off from the outlet opening 30 by a control edge 32 of the annular groove 29. Depending upon the position of the piston slide 22, the inlet opening 31 is closed by the piston slide 22, or else a cross section of greater or lesser size is opened up between the inlet opening 31 and the annular groove 29. In the section between the outlet opening 30 and the fuel supply container 36 of the connecting line 21, there is a check valve 33 opening toward the fuel supply container 36. The relieved side of the check valve 33 is connected with the relief chamber 28 of the cylinder 23. The piston slide 22 has a longitudinal bore 34 passing all the way through it, and a first throttle restriction 35 is embodied in the longitudinal bore 34 near its point of discharge into the control chamber 25.

The injection pump 4 is supplied with fuel from the fuel supply container 36 via a fuel supply line 37 in which a fuel supply pump 38 is disposed. To this end, the fuel supply line 37 discharges into the suction chamber 20 of the injection pump 4. A fuel filter 39 is disposed if needed in the fuel supply line 37, between the fuel supply pump 38 and the suction chamber 20. A line 41 provided with an overflow throttle 40 leads back to the fuel supply container 36 from the suction chamber 20 of the injection pump 4. With the overflow throttle 40, it is possible to attain a desired, substantially constant, fuel supply pressure in the suction chamber 20 of the injection pump 4; this pressure can also be further influenced in accordance with selected operating parameters, such as the air pressure or the temperature.

A control line 42 leads from the suction chamber 20 to the control chamber 25 on the piston slide 22. A second throttle restriction 43 is embodied in the control line 42. The suction chamber 20, which is under substantially constant pressure, and the second throttle restriction 43 represent the pressure source for a subsequent pressure control device 44, by which in turn the piston slide 22 of the throttle device in the connecting line 21 between the pump work chamber 8 and the fuel supply container 36 can be adjusted, and by which the injection quantity can thus also be determined by regulating the throttle cross sections 29, 31, 32 in the connecting line 21.

The pressure control device is embodied, in the exemplary embodiment, as a magnetic valve 44, the adjusting member 45 of which is controllable by means of signals of the electronic control unit 19. Serving as a feedback signal for the correct supply quantity during idling is the idling rpm n, which reaches the electronic control unit 19 from a transducer 46. The electronic control unit 19 is also influenced by the position of the gas pedal 47, so as to make the influence of rpm on the control unit 19 effective only during idling.

The piston slide 22 of the throttle device is also provided with a transverse bore 48, which discharges into a leakage groove 49 on the circumference of the piston slide 22. Fuel flowing into the cylinder 23 between the annular groove 29 and the control chamber 25 can thus pass from the circumference of the control slide 22 via the longitudinal bore 34 to the relief chamber 28, without undesirably affecting the pressure of the fuel in the control chamber 25.

For starting of the engine, it must be assured that the entire quantity of fuel pumped into the pump work chamber 8 will reach the injection valves 2 via the associated injection lines 3. The annular slide 16 is kept by the servomotor 18 in the full-load position, in which the relief conduit 15 is closed. The inlet and outlet openings 31 and 30, respectively, in the cylinder 23 of the throttle device and the annular groove 29 of the piston slide 22 having the control edge 32 are furthermore so embodied that upon engine starting, the inlet opening 31 is closed by the piston slide 22, and thus the second outlet of the pump work chamber 8, that is, the connecting line 21, is also closed.

Since in the described fuel injection pump the duration of injection is determined by the position of the annular slide 16, the maximum prolongation of the duration of injection is attained by positioning the annular slide 16 in the full-load position. This position of the annular slide is also maintained during idling. The injection quantity is then determined by the rpm. The transducer 46 detects the idling rpm, as a result of which a corresponding signal is emitted by the electronic control unit 19 to the pressure control device embodied as a magnetic valve 44, 45. From the suction chamber 20, which is under substantially constant pressure, and through the second throttle restriction 43 inserted into the control line 42, fuel flows at a predetermined pressure to the magnetic valve 44, 45. In accordance with the signals at the magnetic valve 44, 45, which are derived from the idling rpm, the pressure in the portion of the control line 42 leading downstream of the magnetic valve 44, 45 to the control chamber 24 is adjusted. A control pressure for the piston slide 22 thus builds up in the control chamber 25 and thus ahead of the first throttle restriction 35. The piston slide 22, acting as a bypass, opens the connecting line 21 from the pump work chamber 8 to the fuel supply container 36. As a result, a portion of the fuel quantity pumped into the pump work chamber 8 is diverted. Only the injection quantity required for the idling rpm still flows from the pump work chamber 8 via the longitudinal conduit 9, the radial bores 10 having the longitudinal distributor grooves 11, and the associated injection lines 3 to reach the respective injection valves 2.

In order to keep the injection quantity required for idling constant, the piston slide 22 and thus the throttle cross section between the inlet opening 31 of the connecting line 21 in the cylinder 23 and the annular groove 29 of the piston slide 22 having the control edge 32 are variable. This is effected by means of feedback signals of the idling rpm via the control unit 19 and the pressure control device 44 and by means of corresponding pressure forces which are exerted, counter to the force of the compression spring 27 in the control chamber 28, upon the piston slide 22.

To this end, the opening time of the magnetic valves 44, 45 is designed such that with a slight quantity of fuel diverted from the suction chamber 20, in accordance with the two throttle restrictions 43 and 35 and the force of the compression spring 27, the pressure required for positioning the piston slide 22 is built up in the control chamber 25, this position of the piston slide 22 being that at which the throttle slit 31, 29, 32 has the cross section necessary for the "bypass quantity" to be diverted from the pump work chamber 8, and in which only the injection quantity sufficient for idling reaches the injection valves 2.

In the unbalanced state, i.e. non-equal pressures, of the quantity regulating device which comprises the pressure control device 44, 45 and the adjusting piston 22 as a throttle device, the adjusting piston 22 is adjusted, because of a pressure change in the control chamber 25 dictated by the rpm-dependent control of the magnetic valve 44, 45 until such time as the quantity of fuel corresponding to the desired idling rpm flows out via the throttle opening 31, 29, 32 into the connecting line 21, and the idling rpm thus corresponds to the prespecified value.

The two throttle restrictions 35 and 43 are designed such that the pressure buildup and pressure reduction are effected in the same length of time. The check valve 33 disposed in the connecting line 21 between the throttle device 22 and the fuel supply container 36 assures that a shift in injection onset is prevented. Its valve spring exerts a sufficiently great force in the closing direction, as a result of which a high pressure level is established between the throttle restriction 31, 29, 32 and the check valve 33. As a result, fuel is not capable of escaping continuously from the pump work chamber 8 through the connecting line 21 during the supply stroke, which would otherwise result in the undesired shift in injection onset.

In order to obtain the most compact possible apparatus, with short pressure lines, the throttle device 22 and the magnetic valve 44, 45 are disposed by way of example on the top of the housing of the injection pump 4. The throttle device 22 is screwed into the top, while the magnetic valve 44, 45 is seated in a flange secured to the top.

The substantial advantages of the fuel injection pump operated in the manner described above is that a constant supply stroke can be maintained, and thus despite minimal injection quantities—that is, such quantities of fuel as are sufficient for idling—a very long duration of injection is attained. As a result, a substantial reduction in combustion noise in Diesel engines during idling is also attained.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection pump comprising a pump piston movable in a closed chamber and a pump work chamber defined thereby, which during a pump intake stroke is supplied with fuel from a pump suction chamber filled with fuel under pressure from a pressure source and which during a pump piston supply stroke can be made to communicate with a fuel injection location, further having a device for adjusting an effective pump piston supply stroke and a relief line leading away from the pump work chamber, a throttle device disposed in a cylinder in the relief line with an end face enclosing a control chamber, which communicates via a pressure line with said pump suction chamber, wherein the pressure line includes a variable throttle therein controlled in accordance with operating parameters and made to communicate with the relief chamber via a relief line in said throttle device containing a first fixed throttle, characterized in that the variable throttle is variable by means of an electrical control unit in accordance with rpm, and a second fixed throttle is disposed between the suction chamber and the variable throttle.

2. A fuel injection pump as defined by claim 1, characterized in that said first fixed throttle is disposed in a relief line in said throttle device leading away from said end face enclosing said control chamber.

3. A fuel injection pump as defined by claim 1, characterized in that said variable throttle comprises a valve means, and said valve means has an adjusting member which is controllable in accordance with rpm by said electrical control unit.

4. A fuel injection pump as defined by claim 1 or 2, characterized in that said variable throttle communicates with said suction chamber, in which said suction chamber is arranged to contain fuel under substantially constant pressure from said pressure source, and a throttle restriction disposed between said suction chamber and said variable throttle.

5. A fuel injection pump as defined by claim 1 or 2, characterized in that said variable throttle communicates with a control line which extends to said control chamber, and further that said control line has a cross section which is adjustable by said variable throttle.

6. A fuel injection pump comprising a pump piston, said pump further having an adjusting member, the position of which determines the duration of the fuel injection effected by said pump piston, and a connecting line leading from a pump work chamber to a fuel withdrawal chamber, said connecting line further including a cross-section adjustable by means of a throttle device in order to determine the injection quantity, characterized in that said throttle device is adjustable by the pressure in a control chamber which is in communication with a pressure source via a pressure control device, said control chamber of said throttle device communicates via a discharge throttle with said fuel withdrawal chamber; and said pressure control device is controllable in accordance with rpm by an electronic control unit.

7. A fuel injection pump as defined by claim 6, characterized in that said throttle device comprises a cylinder with a control slide guided therein, which is disposed between said control chamber and a spring, said control slide further including a control edge which varies the cross section of said connecting line.

8. A fuel injection pump as defined by claim 7, further characterized in that said control slide has a jacket face, and an annular groove thereon which is in permanent connection with one part of said connecting line and said control edge comprises a limiting edge defining said annular groove on said jacket face, and controlling the cross section of an other part of said connecting line branching off at the wall of said cylinder.

9. A fuel injection pump as defined by claim 6 or 2, characterized in that by means of said electronic control unit said adjusting member which includes a servomotor for determining a duration of fuel supply, is simultaneously controlled.

10. A fuel injection pump as defined by claim 6 or 2, characterized in that said adjusting member comprises an annular slide which opens up a relief conduit of said pump work chamber.

11. A fuel injection pump as defined by claim 6, characterized in that a check valve is disposed in said connecting line between said throttle device and said withdrawal chamber.

* * * * *